US006449874B2

(12) United States Patent
Pellinen

(10) Patent No.: US 6,449,874 B2
(45) Date of Patent: Sep. 17, 2002

(54) METHOD FOR BLOWING STEAM AGAINST PAPER WEB, AND STEAM BOX OF PAPER MACHINE

(75) Inventor: Kari Pellinen, Säynätsalo (FI)

(73) Assignee: Metso Paper Automation Oy, Tampere (FI)

( * ) Notice: Subject to any disclaimer, the term of this patent is extended or adjusted under 35 U.S.C. 154(b) by 0 days.

(21) Appl. No.: 09/808,565

(22) Filed: Mar. 14, 2001

(30) Foreign Application Priority Data

Apr. 6, 2000 (FI) ..... 20000816

(51) Int. Cl.[7] ..... F26B 3/00

(52) U.S. Cl. ..... 34/452; 34/114; 34/122; 34/124; 34/130

(58) Field of Search ..... 34/114, 122, 124, 34/130, 451, 452, 443, 444; 162/207

(56) References Cited

U.S. PATENT DOCUMENTS

| | | | | |
|---|---|---|---|---|
| 4,573,402 A | | 3/1986 | Sharma et al. | |
| 4,662,398 A | * | 5/1987 | Wywailowski et al. | 137/625.4 |
| 5,059,285 A | | 10/1991 | Winheim | |
| 5,090,133 A | | 2/1992 | Taylor | |
| 5,385,644 A | * | 1/1995 | Hannus et al. | 162/207 |
| 5,416,980 A | * | 5/1995 | Ilvespaa | 34/116 |
| 5,689,897 A | | 11/1997 | Schiel | |
| 5,749,158 A | | 5/1998 | Muller et al. | |

FOREIGN PATENT DOCUMENTS

| | | | |
|---|---|---|---|
| DE | 3614534 A1 | | 7/1987 |
| EP | 1081278 A2 | * | 9/2000 |
| FI | 101727 B | | 8/1998 |

OTHER PUBLICATIONS

Copy of Search Report for European Patent Application No. EP 01 10 6476, completed Sep. 3, 2001.

* cited by examiner

*Primary Examiner*—Jiping Lu
(74) *Attorney, Agent, or Firm*—Alston & Bird LLP

(57) ABSTRACT

A method for blowing steam against a paper web, whereby the steam is blown by a steam box having several profiling chambers in the cross direction of a paper machine. The cross-profile of the paper web is controlled by the steam supplied by the profiling chambers. A gas flow is provided between the profiling chambers to prevent the steam blown by a profiling chamber from affecting the effective area of the steam blown by the adjacent profiling chamber. Further, a steam box for implementing the method is disclosed.

22 Claims, 2 Drawing Sheets

METHOD FOR BLOWING STEAM AGAINST PAPER WEB, AND STEAM BOX OF PAPER MACHINE

Figure 1:
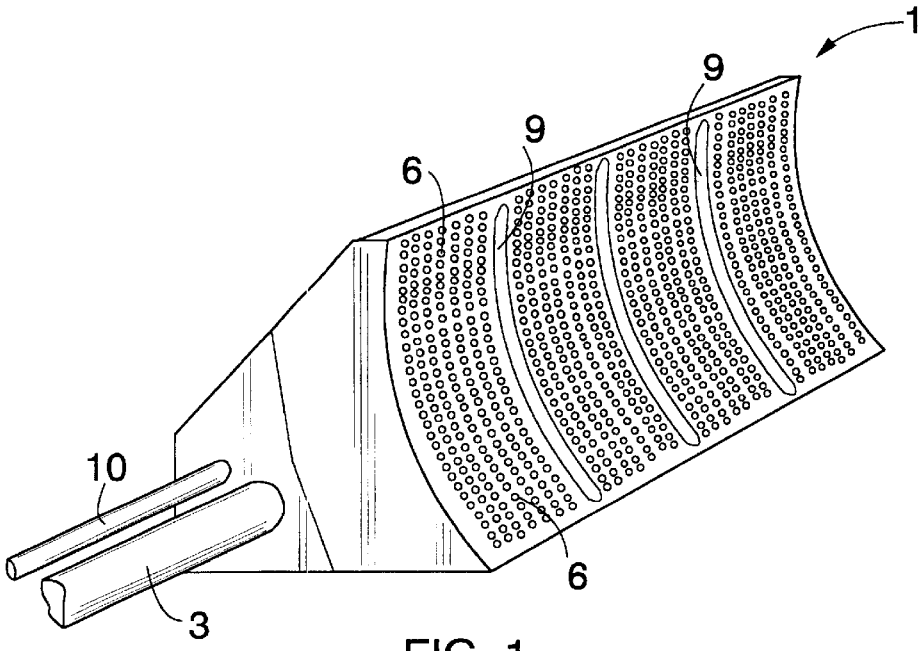

The invention relates to a method for blowing steam against a paper web, in which method the steam is blown by a steam box having several profiling chambers in the cross direction of the paper machine, and the steam blown by the profiling chambers is used to control the cross-profile of the paper web, and each profiling chamber blows steam to its own effective area on the paper web.

Further, the invention relates to a steam box of a paper machine having several profiling chambers in the cross direction of the paper machine, and the profiling chambers are arranged to control the cross-profile of the paper web in such a manner that each profiling chamber is arranged to blow steam to its own effective area on the paper web.

Paper machines use steam boxes which are used to blow steam against the paper web. The steam box is installed perpendicular to the direction of travel of the paper web in such a manner that it extends across the entire width of the web. By means of steam boxes it is, for instance, possible to increase the capacity of the paper machine. The steam box can, for instance, be arranged in the press and/or wire section of the paper machine, in which case the steam box can, for instance, be used to increase the temperature of the paper web, and, by means of press nips and dewatering equipment, to drain the warmed water more easily and thus increase the dry content and improve the drying capacity of the dryer section. Further, the steam box can be used to correct the moisture profile of the paper web, if necessary. Correcting the moisture profile is done by applying a different amount of steam at different locations to the paper web in its cross direction. The steam box is in its cross direction usually divided into several chambers, or profiling chambers, which each have a separate steam supply. Steam boxes can be used in many other parts of the paper machine, such as the dryer section, calendering, and paper converting machines.

Finnish patent 101 727 discloses a steam box which has a steam chamber for blowing steam towards the paper web and a suction zone extending across the entire paper web in the output direction of the machine, the suction zone being located after the steam chamber in the direction of travel of the paper. The purpose of the suction zone is to prevent the spreading of steam spray to the paper machine surroundings, i.e. to suck the excess steam away. After the suction zone, in the direction of travel of the web, there is a blow nozzle for slowing down the steam flow along the web past the suction zone. It is, however, not possible to control the cross-profile of the paper web with the described solutions.

U.S Pat. No. 4,662,398 discloses a steam box of a paper machine, in which steam is fed through a steam supply pipe to a steam space inside the steam box. The steam box is in the cross direction of the web divided into consecutive chambers, and steam is led to each chamber from the steam space through adjustable valves in each chamber. One wall of each chamber is a nozzle plate through which steam affects the paper web. By means of the valves, it is possible to adjust the amount of steam flowing into each chamber specifically for each chamber and thus, by means of the profiling chambers in question, it is possible to control the cross-profile of the paper web.

Finnish publication 963 583 discloses a steam box of a paper machine, in which the valves controlling the amount of steam are arranged outside the steam box, and steam is led into steam chambers through pipes specific for each chamber. The purpose is to make the profiling chambers as small as possible and thus, to direct the profiling effect to as many locations as possible in the cross direction of the paper web. However, the steam pipes cause rather high flow and heat losses, which means that controlling the cross-profile of the paper web is very difficult and uncertain by means of the steam box in question. Further, the high number of chambers makes the control very complex. As a whole, the solution is quite expensive and difficult in structure.

The problem with trying to achieve a profiling effect on the paper web by means of a steam box is that the steam blown by a profiling chamber also spreads in the cross direction of the paper web to the effective area of the steam blown by the adjacent profiling chamber. To improve the profiling effect, the number of profiling chambers has been increased. However, the width of one profiling chamber in the cross direction of the machine then becomes quite small. The width of one profiling chamber in the cross direction of the machine can be 50 mm, for instance. The distance of the steam box from the surface of the paper web can be 10 to 30 mm, for instance. In such a case, the steam blown by a profiling chamber may even affect almost the entire effective area of the adjacent profiling chambers, and the desired profiling effect on a specific web location is not achieved. This makes controlling the profiling effect of the steam box very difficult, i.e. the profiling effect as a whole is unsatisfactory.

It is an object of the present invention to provide a method and a steam box, by means of which it is possible to improve the profiling effect of the steam box.

The method of the invention is characterized in that a gas flow is provided between the effective areas of the profiling chambers to prevent the steam blown by a profiling chamber from affecting the effective area of the steam blown by the adjacent profiling chamber.

Further, the steam box of the invention is characterized in that the steam box has intermediate nozzles between the profiling chambers for providing a gas flow in such a manner that the gas flow is arranged to prevent the steam blown by a profiling chamber from affecting the effective area of the steam blown by the adjacent profiling chamber.

The essential idea of the invention is that the steam box has in cross direction of the paper machine several profiling chambers, and the steam blown from the profiling chambers is used to control the cross-profile of the paper web. A gas flow is provided between adjacent profiling chambers to prevent the steam blown by a profiling chamber from affecting the effective area of the steam blown by the adjacent profiling chamber. The idea of a preferred embodiment is that steam supplied by the profiling chambers is sucked from between the profiling chambers. The idea of a second preferred embodiment is that intermediate nozzles are arranged between the profiling chambers, and they are used to blow gas between the effective areas of the steam blown by the profiling chambers. The idea of a third preferred embodiment is that the gas blown between the effective areas of the steam blown by the profiling chambers is air. The idea of a fourth preferred embodiment is that steam is blown between the effective areas of the steam blown by the profiling chambers. The idea of a fifth preferred embodiment is that the blowing rate of the gas is arranged to be higher than the rate of the steam blown by the profiling chambers. The idea of a sixth preferred embodiment is that the temperature of the gas blown between the effective areas of the steam blown by the profiling chambers is substantially equal to the temperature of the steam blown by the profiling chambers.

The invention provides the advantage that it is possible to slow down and thus reduce the movement of the steam blown by the profiling chamber in the cross direction of the paper machine, i.e. to prevent the spreading of the steam in the cross direction of the paper machine. This means that the effective area of the steam blown by different profiling chambers of the steam box can be directed exactly to the desired location of the web, i.e. the profiling effect of the steam box improves. By sucking steam away from between the profiling chambers, it is possible to easily improve the profiling effect without affecting the paper web properties between the profiling chambers. On the other hand, blowing gas between the effective areas of the steam blown by the profiling chambers is simple to implement. Blowing air between the effective areas of the steam blown by the profiling chambers is quite effective, because air binds steam quite efficiently. Blowing steam is easy to arrange, because steam is readily available from the steam box. By arranging the temperature of the blown gas to be the same as the temperature of the steam blown by the profiling chamber means that the effect of the gas blown between the effective areas of the steam blown by the profiling chambers does substantially not differ from the effect of the steam blown by the profiling chambers on the paper web.

In this description, the term 'paper' refers to the different embodiments of paper, such as board, tissue, and pulp.

Figure 2:
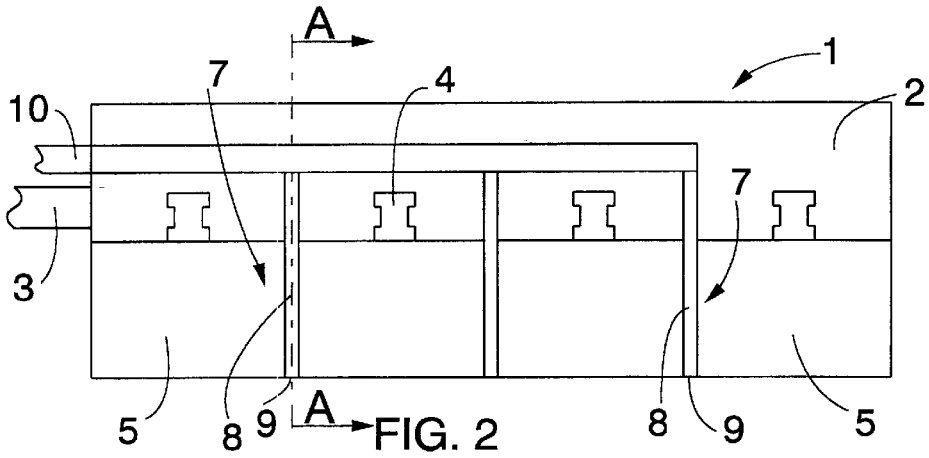
Figure 3:
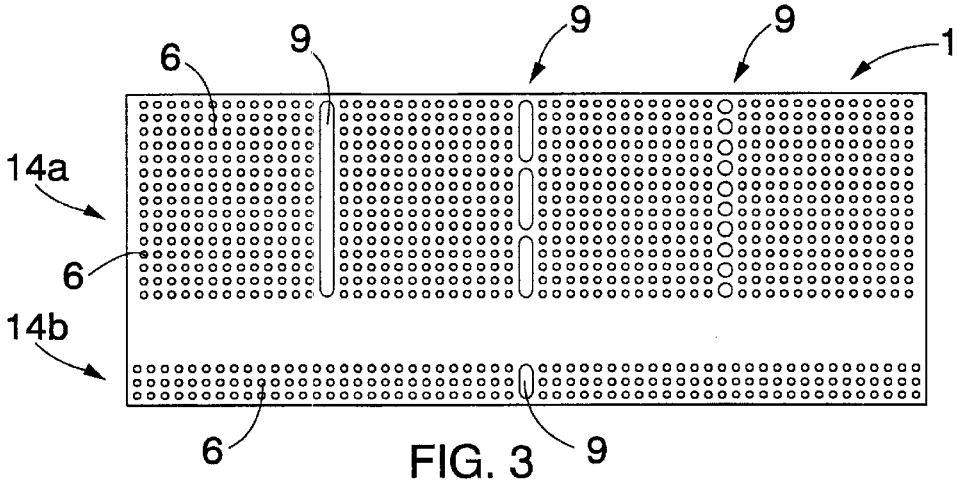
Figure 4:
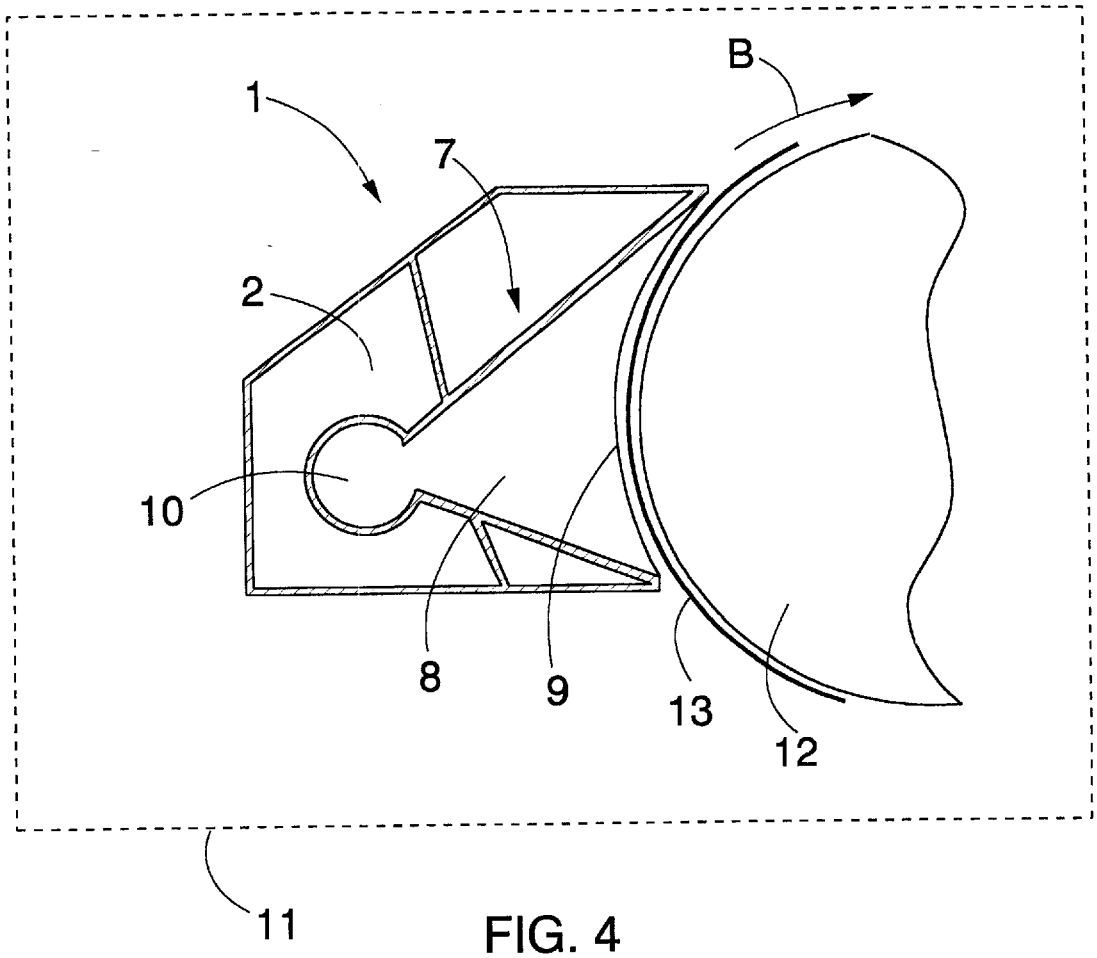

The invention is described in greater detail in the accompanying drawings in which FIG. 1 shows a schematic view of a steam box of the invention in perspective, FIG. 2 shows a side view of the steam box of FIG. 1 in cross section, FIG. 3 shows a schematic view of a second steam box from the direction of the web, and FIG. 4 shows the steam box of FIG. 1 in cross section along the A—A line of FIG. 2.

FIG. 1 shows a steam box 1 of a paper machine. The steam box I blows steam on a paper web which, for clarity's sake, has not been shown in FIG. 1. The internal structure of the steam box 1 is shown more exactly in FIG. 2 showing the cross-section of the steam box 1. The steam box 1 has a steam space 2 to which steam is fed through a steam supply pipe 3. Adjustable valves 4 are arranged in the steam space 2. Steam in the steam space 2 is led through the valves 4 to profiling chambers 5. The number of the profiling chambers 5 equals the valves 4 in the steam box 1. FIG. 1 shows considerably fewer profiling chambers than there actually are. A typical steam box 1 can, for instance, comprise 30 to 200 profiling chambers 5. The wall of the profiling chamber 5 which is against the paper web is a nozzle plate or diffusion plate having several holes 6 as shown in FIG. 1. A typical diameter of the holes 6 is 1 to 3 mm. Through the holes 6, steam flows to the paper web. Each valve 4 is adjusted by means of a regulating element. It is then possible to adjust the amount of steam flowing into each profiling chamber 5 and thus also to adjust fully the amount of steam affecting the paper web in cross direction with respect to the direction of travel of the paper web. This means that the properties of the paper web can be adjusted in a desired manner in its cross direction. By means of steam directed through the profiling chambers 5, it is possible to adjust the temperature of the paper web which together with the press nips and other nips located after the steam box affects the dry content. A profiling effect is thus achieved by means of the steam box 1, i.e. the cross-profile of the paper web is controlled, for instance when the moisture profile of the paper web needs to be corrected. Profiling is known to a person skilled in the art and is, therefore, not described in greater detail herein.

The steam box 1 further comprises intermediate nozzles 7 arranged between the profiling chambers 5. The intermediate nozzle 7 comprises a nozzle chamber 8 and a nozzle opening 9. The intermediate nozzles 7 are further connected to a main channel 10. Through the main channel 10, gas, for instance, can be fed to the intermediate nozzles 7. The gas can be steam or air, for instance. In this description the term 'gas' refers to steam, air or another suitable gas or gas mixture.

The supplied gas is led by means of the intermediate nozzle 7 towards the paper web in such a manner that a gas curtain is formed between the effective areas of the steam blown by the profiling chambers 5. The effective area of the steam blown by the profiling chambers 5 refers to the part of the paper web surface, to which the steam blow of the profiling chamber 5 is intended to be directed. The gas supplied by the intermediate nozzles 7 then prevents the steam supplied by the profiling chambers 5 from flowing on the surface of the paper web in the cross machine direction. The intermediate nozzle 7 is arranged to be such that the amount of gas flowing through it is small, but its rate or speed fairly high. When the amount of the flowing gas is kept fairly small, it does not dry the paper web or leave stains in the paper. The width, i.e. the dimension in the cross machine direction, of the nozzle opening 9 can be 1 to 5 mm, for instance, or even less than 1 mm. The pressure of the supplied gas can vary between 20 and 90 kPa, for instance, but can be higher, preferably the pressure is between 20 and 200 kPa. The rate of the steam supplied by the profiling chambers 5 is made slightly higher than the speed of the paper web. The rate of the gas spray supplied by the intermediate nozzles 7 is most preferably made slightly higher than the rate of the steam supplied by the profiling chambers 5. The supply rates vary typically from 10 to 35 m/min. For instance, if the rate of the steam supplied by the profiling chambers 5 is 20 m/min on an average, the rate of the gas supplied by the intermediate nozzles 7 is set to 25 m/min. The flow rate of gas is adjusted by adjusting its pressure. The flow rate can be dimensioned for instance by defining what the flow rate of the steam supplied by the profiling chamber 5 is when the valve 4 is half open.

The gas supplied by the intermediate nozzles 7 can be air, for instance. Air binds steam quite efficiently, and it is thus possible in an effective manner to prevent the steam supplied by the profiling chamber 5 from spreading to the effective area of the steam blown by the adjacent profiling chamber 5. The air can be either hot or cold. When using hot air, its temperature can be adjusted to be substantially equal to the temperature of the steam supplied by the profiling chambers 5, in which case the effect of the air on the paper web surface remains small.

Further, the gas to be supplied can be steam, for instance. In this case, the gas supplied by the intermediate nozzles 7 has substantially the same effect on the paper web as the steam supplied by the profiling chambers 5. Further, when using steam, it is possible use steam from the steam space 2, which ensures that the temperature of the steam supplied by the intermediate nozzles 7 is substantially equal to the temperature of the steam supplied by the profiling chambers 5. Further, in this case, the main channel 10 is not necessarily required, and at the simplest it is enough to make a hole or holes from the steam space 2 to the nozzle chambers 8, through which steam can flow from the steam space 2 to the nozzle chambers 8.

The structure of the steam box 1 is simple when an end wall of the profiling chamber 5 forms a major part of one wall of the nozzle chamber 8. In this case, two walls of the nozzle chamber 8 are formed by the end walls of the profiling chambers 5 at different sides of the intermediate nozzle 7. Further, existing steam boxes can in a fairly simple manner be converted to be according to the invention by adding in addition to the existing partition wall between the profiling chambers 5 a new plate between them at a distance of approximately 1 mm, for instance, from the first partition wall. A nozzle chamber 8 is then formed between said plates. In addition to this, a nozzle opening 9 is naturally formed, and a flow opening for the steam is arranged from the steam space 2 to the new nozzle chamber 8.

By means of the main channel 10 and the intermediate nozzle 7, the steam blown by the profiling chambers 5 can also be sucked through the nozzle openings 9. In this case, the steam supplied by the profiling chamber 5 and spreading sideways does not enter the effective area of the steam blown by the adjacent profiling chamber 5, but is sucked by the intermediate nozzle in to the main channel 10 and onward to be led away.

Three different alternative shapes of the nozzle opening 9 are shown in FIG. 3. Naturally, one of the shapes in question would be typically used in one steam box 1. The nozzle opening 9 can thus be an elongated hole as shown on the left in FIG. 2. On the other hand, the nozzle opening 9 can also be made up of several consecutive holes as shown on the right in FIG. 2. Further, it is possible that the nozzle opening 9 is formed of several consecutive elongated holes as shown in the middle of FIG. 2. However, the decisive factor is only the dimensioning of the open surface area of the nozzle opening 9. Naturally, the length of the nozzle opening 9 in machine direction is substantially at least equal to the length of the diffusion plate of the profiling chamber 5 in the longitudinal direction of the machine.

The steam box 1 may comprise not only a main steam zone 14*a* formed by the profiling chambers 5, but also a secondary steam zone 14*b* which is intended to form a steam curtain preventing the air flowing with the paper web from entering between the steam box 1 and the paper web 13. In addition to or instead of this, the task of the secondary steam zone can be to prevent steam from exiting between the steam box 1 and the paper web 13 when the secondary steam zone is located after the main steam zone in the direction of travel of the paper web 13. Further, the paper web 13 can be pre-heated by means of the secondary steam zone, and, if necessary, the average distortion of the paper web 13 moisture profile can be corrected, if the secondary steam zone is divided into two or more sections. If the secondary steam zone is divided into two or more sections, it is possible to arrange intermediate nozzles 7 of the invention between the sections. In the embodiment shown in FIG. 3, the secondary steam zone 14*b* is divided into two sections.

FIG. 4 shows a cross-section of the steam box 1 at the location of the intermediate nozzle 7. For clarity's sake, in FIG. 4, the walls of the steam box 1 are shown thicker than in a normal situation. In FIG. 4, the steam box 1 is arranged to a roll 12 in a paper machine 11 to blow steam on the paper web 13. The steam box can also be planar, in which case it is installed to blow steam to the paper web when the web is supported by a wire or felt. The paper web 13 moves in the direction shown by arrow B. The steam box 1 of the invention can be arranged on the press section of the paper machine 11 or as necessary to any other location on the paper machine 11, such as the wire section, drying section or calendering. The paper machine 11 is shown schematically by a dashed line, and no other parts of the paper machine 11 are shown, because the structure and operation of the paper machine 11 is obvious to a person skilled in the art.

The drawings and the related description are only intended to illustrate the idea of the invention. The invention may vary in detail within the scope of the claims. Therefore, the structure of the steam box may be such that the valves 4 are in the steam space 2 as shown in FIG. 1, but the steam is led to the profiling chamber 5 from the valve 4 through a channel. On the other hand, the structure of the steam box may be such that the steam is led from the steam space 2 through a channel to the valve, in which case the valve 4 is located in the profiling chamber 5 as shown in U.S. Pat. No. 4 915 788, for instance. The structure of the steam box may also be such that the steam space is arranged in the middle of the profiling chambers as shown in U.S. Pat. No. 4,662, 398, for instance.

What is claimed is:

1. A method for blowing steam against a paper web, the method comprising providing a steam box having several profiling chambers in the cross direction of a paper machine, each profiling chamber having its own effective area, blowing the steam by the profiling chambers to control the cross-profile of the paper web, each profiling chamber blowing steam to the paper web to its own effective area, and providing a gas flow between the effective areas of the profiling chambers to prevent the steam blown by a profiling chamber from affecting the effective area of the steam blown by the adjacent profiling chamber.

2. A method as claimed in claim 1, wherein the steam supplied by the profiling chambers is sucked from between the profiling chambers.

3. A method as claimed in claim 1, wherein gas is blown between the effective areas of the steam blown by the profiling chambers.

4. A method as claimed in claim 3, wherein air is blown between the effective areas of the steam blown by the profiling chambers.

5. A method as claimed in claim 3, wherein steam is blown between the effective areas of the steam blown by the profiling chambers.

6. A method as claimed in claim 3, wherein gas is blown between the effective areas of the steam blown by the profiling chambers at a greater rate than the rate of the steam blow produced by the profiling chambers.

7. A method as claimed in claim 3, wherein the temperature of the gas blown between the effective areas of the steam blown by the profiling chambers is arranged to be substantially equal to the temperature of the steam blown by the profiling chambers.

8. A method as claimed in claim 3, wherein the pressure of the gas blown between the effective areas of the steam blown by the profiling chambers is arranged to be between 20 and 200 kPa.

9. A steam box of a paper machine, comprising several profiling chambers in the cross direction of the paper machine, which profiling chambers are arranged to control the cross-profile of the paper web in such a manner that each profiling chamber is arranged to blow steam to its own effective area on the paper web, the steam box comprising intermediate nozzles between the profiling chambers for providing a gas flow in such a manner that the gas flow is arranged to prevent the steam blown by a profiling chamber from affecting the effective area of the steam blown by the adjacent profiling chamber.

10. A steam box as claimed in claim 9, wherein the intermediate nozzle comprises a nozzle chamber and a nozzle opening.

11. A steam box as claimed in claim 10, wherein an end wall of the profiling chamber forms a major part of one wall of the nozzle chamber.

12. A steam box as claimed in claim 10, wherein the width of the nozzle opening is 1 to 5 mm.

13. A steam box as claimed in claim 10, wherein the nozzle opening is one elongated hole.

14. A steam box as claimed in claim 10, wherein the nozzle opening is made up of several consecutive holes.

15. A steam box as claimed in claim 14, wherein the nozzle opening is made up of several consecutive elongated holes.

16. A steam box as claimed in claim 9, wherein the intermediate nozzles are arranged to blow gas between the effective areas of the steam blown by the profiling chambers.

17. A steam box as claimed in claim 16, wherein the intermediate nozzles are arranged to blow air between the effective areas of the steam blown by the profiling chambers.

18. A steam box as claimed in claim 16, wherein the intermediate nozzles are arranged to blow steam between the effective areas of the steam blown by the profiling chambers.

19. A steam box as claimed in claim 16, wherein the rate of the gas blown between the effective areas of the steam blown by the profiling chambers is arranged to be greater than the rate of the steam blow produced by the profiling chambers.

20. A steam box as claimed in claim 16, wherein the steam box comprises a main channel, and the intermediate nozzles are connected to the main channel, and the gas blown is arranged to be fed to the intermediate nozzles on the main channel.

21. A steam box as claimed in claim 16, wherein the steam box comprises a steam space and valves for feeding the steam from the steam space to the profiling chambers, and that the steam box comprises means for feeding steam from the steam space to the intermediate nozzles.

22. A steam box as claimed in claim 9, wherein the steam box comprises a main channel which is connected to the intermediate nozzles, and that the intermediate nozzles are arranged to suck from between the profiling chambers the steam supplied by the profiling chambers.

* * * * *